US009693144B1

(12) United States Patent
Ohara

(10) Patent No.: US 9,693,144 B1
(45) Date of Patent: Jun. 27, 2017

(54) DAMPER HAVING A LOCALLY COATED MATERIAL AND ITS FABRICATION METHOD

(71) Applicant: Hiroshi Ohara, Taoyuan (TW)

(72) Inventor: Hiroshi Ohara, Taoyuan (TW)

( * ) Notice: Subject to any disclaimer, the term of this patent is extended or adjusted under 35 U.S.C. 154(b) by 0 days.

(21) Appl. No.: 14/977,946

(22) Filed: Dec. 22, 2015

(51) Int. Cl.
*H04R 1/00* (2006.01)
*H04R 7/26* (2006.01)
*H04R 31/00* (2006.01)

(52) U.S. Cl.
CPC ..... *H04R 7/26* (2013.01); *H04R 31/003* (2013.01)

(58) Field of Classification Search
CPC ..... H04R 1/06; H04R 1/021; H04R 1/022; H04R 7/00; H04R 7/12; H04R 7/16; H04R 7/18; H04R 7/20; H04R 7/26; H04R 7/122; H04R 9/02; H04R 9/06; H04R 9/041; H04R 9/043; H04R 9/045; H04R 31/003; H04R 2307/207
USPC ..... 381/398, 403, 404; 181/166, 171, 172
See application file for complete search history.

(56) References Cited

U.S. PATENT DOCUMENTS 9,277,303 B2 * 3/2016 Busenitz ..... H04R 1/00

FOREIGN PATENT DOCUMENTS

TW M396605 U1 1/2011
TW 201129125 A1 8/2011

* cited by examiner

*Primary Examiner* — Brian Ensey
(74) *Attorney, Agent, or Firm* — Lin & Associates Intellectual Property, Inc.

(57) ABSTRACT

A method of fabricating a damper is described. A printed pattern is formed on a screen, the printed pattern having an outer edge and a non-circular inner edge. A fiber fabric is soaked in a resin bath, and has a damper forming region provided with a predetermined coating region. The fiber fabric is placed below the screen so that the printed pattern is aligned with the predetermined coating region. A coating material is then poured over the screen so as to flow through a gap region of the printed pattern onto the predetermined coating region. After the fiber fabric has undergone baking, the inner edge of the predetermined coating region can be converted from the non-circular shape to a predetermined shape. The coating material thereby is distributed over the surface of the damper in a substantially regular and uniform manner.

7 Claims, 5 Drawing Sheets

DAMPER HAVING A LOCALLY COATED MATERIAL AND ITS FABRICATION METHOD

BACKGROUND OF THE INVENTION

1. Field of the Invention

The present invention relates generally to a damper and its method of fabrication, and more particularly, to a damper having a locally coated material fabricated by a printing technique.

2. The Prior Arts

Typical component parts of a loudspeaker include a diaphragm, a voice coil, and a damper placed between the diaphragm and the voice coil. The damper can keep the voice coil at a correct position in the magnetic gap, ensure that the vibrating system reciprocates axially upon the application of a force on the voice coil, cooperate with the voice coil and the diaphragm to determine the resonance efficiency of the loudspeaker, and prevent dust in the magnetic gap.

For fabricating the damper, a roll of a fiber fabric is usually soaked in a resin bath, baked, cut and severed to form an entire damper. The fiber fabric after being baked has an increased stiffness owing to the prior resin bath. Unfortunately, the damper fabricated according to the aforementioned method may have an excessive stiffness and lack flexibility, which may create noise and affect the reproduction of bass sound.

Taiwan Patent No. M396605 and Taiwan Patent Application Publication No. 201129125 describe dampers and its manufacture method. According to these prior disclosures, a coating material is applied on a predetermined coating region of the damper, whereby the region of the formed damper having the coating material can be softened compared to other regions having no coating material. This can address the excessive stiffness problem in the fabrication of the damper.

In the aforementioned prior art method, the fiber fabric is extended in the warp direction, and the ability of the fiber fabric to extend and elastically retract is usually better in the weft direction than in the warp direction. As a result, the predetermined coating region can have more inward wrinkles in the weft direction than in the warp direction, resulting in an irregular distribution of the coating material on the surface of the damper. For example, the predetermined coating region may initially have a circular shape, which may become an oval shape after baking of the fiber fabric applied with the coating material. The region of the damper softened by the coating material thus may become significantly irregular and greatly differ from the initial circular shape, which may subject to even more noise and adversely affect the sound quality of the loudspeaker.

Moreover, the inward wrinkles formed on the predetermined coating region of the fiber fabric in the weft direction may differ among different dampers, so that the softened region may be inconsistent between different dampers. As a result, the resonance efficiency of each loudspeaker determined by the damper, the voice coil and the diaphragm may not be similar. In other words, the sound quality of the manufactured loudspeakers may be inconsistent owing to the aforementioned problem.

SUMMARY OF THE INVENTION

A primary objective of the present invention is to provide a method of fabricating a damper having a surface on which a coating material can be distributed in a regular and uniform manner, so that the region softened by the coating material can be substantially consistent for each formed damper.

Another objective of the present invention is to provide a damper in which a predetermined coating region of a damper forming region on a fiber fabric has a particular shape.

For achieving the foregoing objectives, the method includes the following steps. A printed pattern is formed on a screen, the printed pattern having an outer edge and an inner edge, the inner edge of the printed pattern being not circular. A fiber fabric is provided, including at least a damper forming region having a predetermined coating region. The fiber fabric is placed below the screen so that the printed pattern is aligned with the predetermined coating region. A coating material then is poured onto the screen and distributed over the printed pattern, whereby the coating material flows through a gap region of the printed pattern onto the predetermined coating region, the predetermined coating region thereby having a shape that matches with that of the printed pattern.

According to one embodiment, the inner edge has four recessed edge portions of curved shapes, two first protruding edge portions of curved shapes, and two second protruding edge portions of curved shapes, each of the recessed edge portions being connected between one first protruding edge portion and one second protruding edge portion, each of the second protruding edge portions protruding toward the outer edge by a distance that is greater than the distance by which each of the first protruding edge portions protrudes toward the outer edge. Moreover, each of the first protruding edge portions has a first apex, the two first protruding edge portions are located at opposite positions, and a first extending line is defined between the first apexes of the two first protruding edge portions, each of the second protruding edge portions has a second apex, the two second protruding edge portions are located at opposite positions, and a second extending line is defined between the second apexes of the two second protruding edge portions, the first and second extending lines intersecting with each other at a center of the printed pattern. The fiber fabric includes a plurality of warps and a plurality of wefts, the warps extending along a warp direction, and the wefts extending along a weft direction perpendicular to the warp direction. When the fiber fabric is placed below the screen, the first extending line is parallel to the warp direction, and the second extending line is parallel to the weft direction. Each of the recessed edge portions has a third apex, a third extending line is defined between the third apexes of the two recessed edge portions adjacent to a same first protruding edge portion, and a fourth extending line is defined between the third apexes of two recessed edge portions adjacent to a same second protruding edge portion, the third extending line being parallel to the weft direction and crossing the first extending line at a first intersection point, and the fourth extending line being parallel to the warp direction and crossing the second extending line at a second intersection point. Each of the first protruding edge portions protrudes toward the outer edge by a distance that is equal to the distance between the first apex of each first protruding edge portion and the first intersection point, and each of the second protruding edge portions protrudes toward the outer edge by a distance that is equal to the distance between the second apex of each second protruding edge portion and the second intersection point. Preferably, the ratio of the distance by which each second protruding edge portion protrudes toward the outer edge to the distance by which each first protruding edge portion protrudes toward the outer edge is equal to 3:2.

According to one embodiment, the damper forming region has an alignment point, and the step of placing the fiber fabric below the screen so that the printed pattern is aligned with the predetermined coating region includes using a position detecting device to detect the alignment point and moving the screen until the printed pattern is aligned with the predetermined coating region.

Furthermore, the present invention provides a damper, which includes a fiber fabric having at least a damper forming region, the damper forming region including a predetermined coating region having an outer edge and an inner edge, the inner edge of the predetermined coating region being non-circular.

According to one embodiment, the inner edge of the predetermined coating region has a wave shape. Preferably, the inner edge of the predetermined coating region has four recessed edge portions of curved shapes, two first protruding edge portions of curved shapes, and two second protruding edge portions of curved shapes. Each of the second protruding edge portions protrudes toward the outer edge by a distance that is greater than the distance by which each of the first protruding edge portions protrudes toward the outer edge. Each of the first protruding edge portions has a first apex, the two first protruding edge portions are located at opposite positions, and a fifth extending line is defined between the first apexes of the two first protruding edge portions. Each of the second protruding edge portions has a second apex, the two second protruding edge portions are located at opposite positions, and a sixth extending line is defined between the second apexes of the two second protruding edge portions. The fiber fabric further includes a plurality of warps and a plurality of wefts, the warps extending along a warp direction, and the wefts extending along a weft direction perpendicular to the warp direction. The fifth extending line is parallel to the warp direction, and the sixth extending line is parallel to the weft direction. Each of the recessed edge portions has a third apex, a seventh extending line is defined between the third apexes of the two recessed edge portions adjacent to a same first protruding edge portion, and an eighth extending line is defined between the third apexes of two recessed edge portions adjacent to a same second protruding edge portion. The seventh extending line is parallel to the weft direction and crosses the fifth extending line at a third intersection point, the eighth extending line is parallel to the warp direction and crosses the sixth extending line at a fourth intersection point. Each of the first protruding edge portions protrudes toward the outer edge by a distance that is equal to the distance between the first apex of each first protruding edge portion and the third intersection point, and each of the second protruding edge portions protrudes toward the outer edge by a distance that is equal to the distance between the second apex of each second protruding edge portion and the fourth intersection point. Preferably, the ratio of the distance by which each second protruding edge portion protrudes toward the outer edge to the distance by which each first protruding edge portion protrudes toward the outer edge is equal to 3:2.

One feature of the present invention is to use a printed pattern of a screen having a non-circular inner edge, such that the predetermined coating region of the damper forming region on the fiber fabric has a non-circular inner edge after having being soaked in the resin bath. After the fiber fabric has undergone the aforementioned processing steps, the inner edge of the predetermined coating region can be converted from a non-circular shape to a predetermined shape. The coating material thereby can be regularly and uniformly distributed on the surface of the damper, so that the region of the damper softened by the coating material is regular and uniform, which can reduce noise occurrence and improve the sound quality of the loudspeaker. Moreover, the region softened by the coating material can be substantially consistent for each formed damper, so that the sound quality of each loudspeaker can be consistent.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

The accompanying drawings are included to provide a further understanding of the invention, and are incorporated in and constitute a part of this specification. The drawings illustrate embodiments of the invention and, together with the description, serve to explain the principles of the invention.

Figure 1:
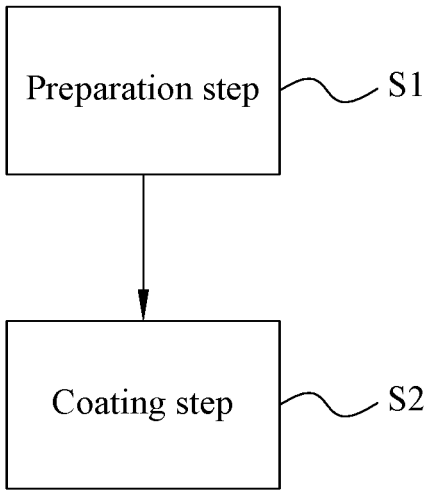
FIG. 1 is a flowchart of the present invention.
Figure 2A:
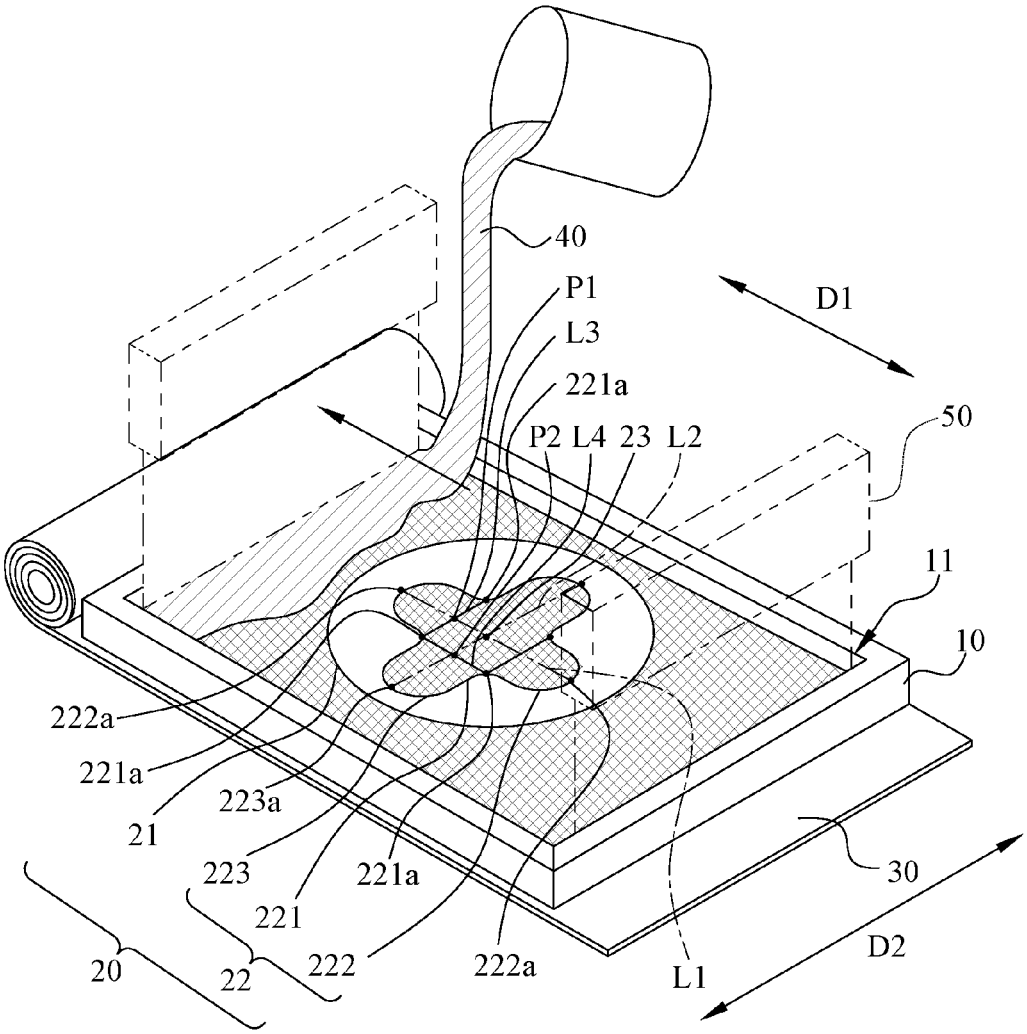
FIG. 2A is a schematic view illustrating a coating step in a method of fabricating a damper for a loudspeaker according to an embodiment of the present invention.
Figure 2B:
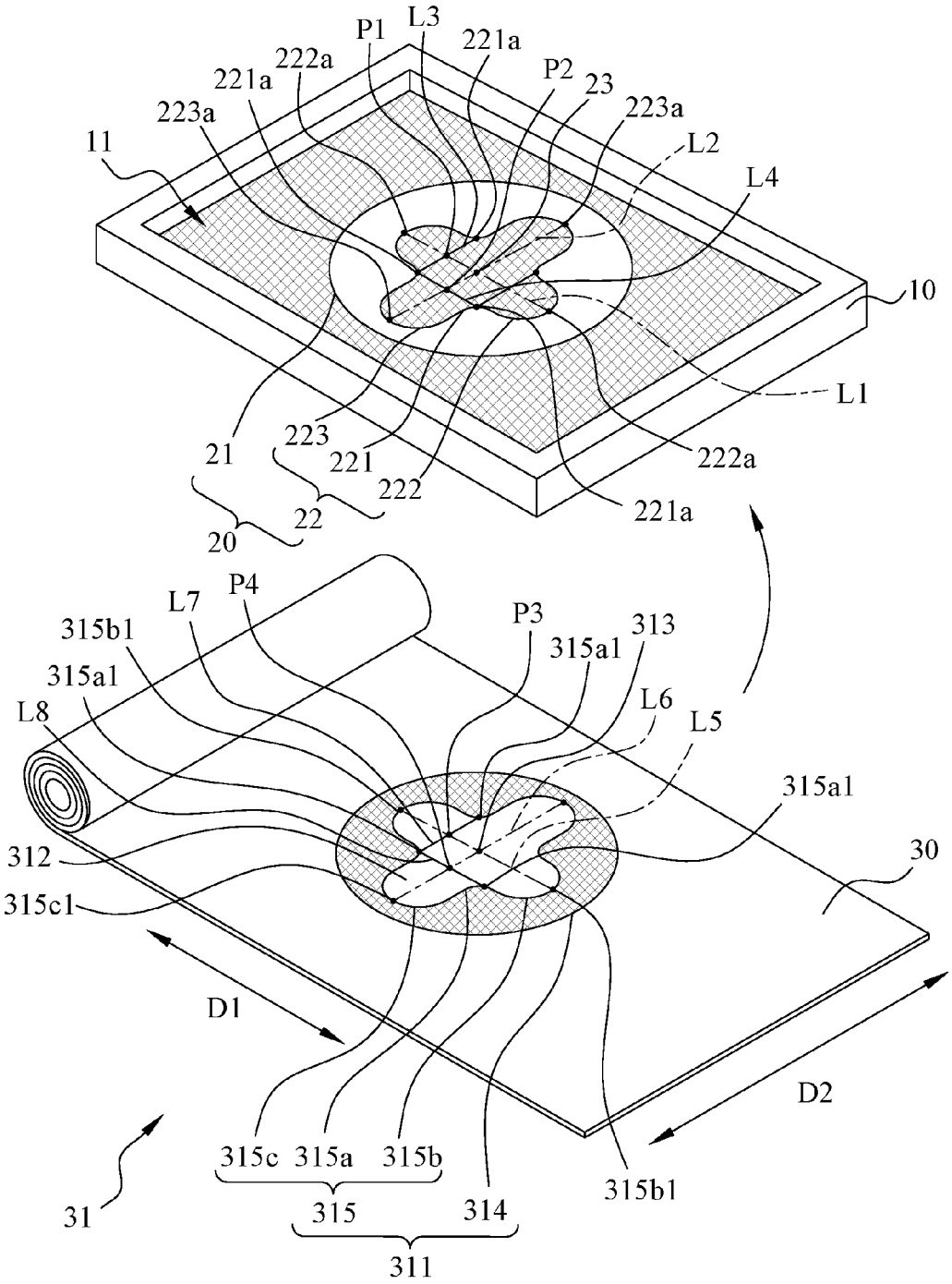
FIG. 2B is a schematic view illustrating a predetermined coating region after application of a coating material thereon.
Figure 2C:
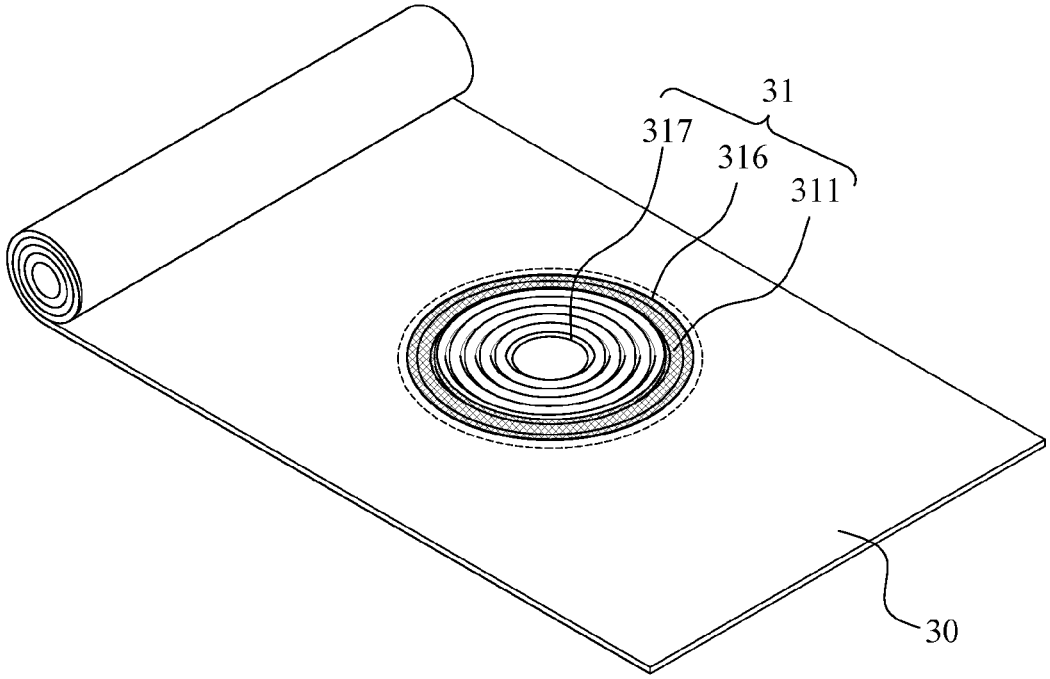
FIG. 2C is a schematic view illustrating a damper formed on a damper forming region of a fiber fabric according to an embodiment of the present invention.
Figure 3:
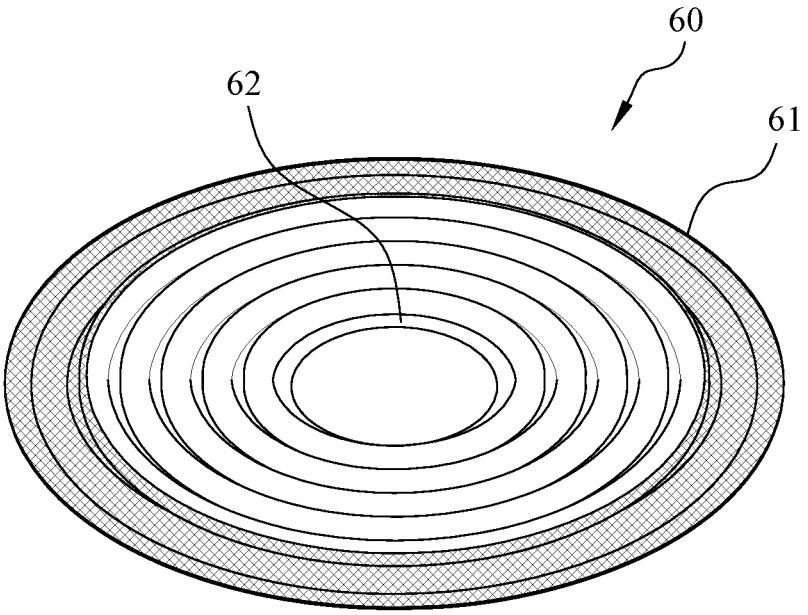
FIG. 3 is a perspective view illustrating a damper fabricated according to an embodiment of the present invention.

Referring to FIGS. 1-3, an embodiment of the present invention provides a method of fabricating a damper having a locally coated material. The method includes the following steps.

In initial preparing step S1, a printed pattern 20 is formed on a screen 10. The printed pattern 20 can have an outer edge 21 and an inner edge 22. As shown in FIG. 2A, the inner edge 22 can have a non-circular shape. Preferably, the outer edge 21 has a circular shape, and the inner edge 22 has a wave shape. In the present embodiment, the inner edge 22 has four recessed edge portions 221 of curved shapes, two first protruding edge portions 222 of curved shapes, and two second protruding edge portions 223 of curved shapes. Each recessed edge portion 221 is connected between one first protruding edge portion 222 and one second protruding edge portion 223. Each second protruding edge portion 223 protrudes toward the outer edge 21 by a distance that is greater than the distance by which each first protruding edge portion 222 protrudes toward the outer edge 21. More specifically, each first protruding edge portion 222 has an apex 222*a*, the two first protruding edge portions 222 are located at opposite positions, and a first extending line L1 is defined between the apexes 222*a* of the two first protruding edge portions 222. Each second protruding edge portion 223 has an apex 223*a*, the two second protruding edge portions 223 are located at opposite positions, and a second extending line L2 is defined between the apexes 223*a* of the two second protruding edge portions 223. The printed pattern 20 has a center 23, and the first and second extending lines L1 and L2 intersect with each other at the center 23. Each recessed edge portion 221 has an apex 221*a*, and a third extending line L3 is defined between the apexes 221*a* of two recessed edge portions 221 adjacent to a same first protruding edge portion 222. A fourth extending line L4 is defined between the apexes 221*a* of two recessed edge portions 221 adjacent to a same second protruding edge portion 223. The third extending line L3 and the first extending line L1 cross each other at a first intersection point P1, and the fourth extending line L4 and the second extending line L2 cross each other at a second intersection point P2. Each first protruding edge portion 222 protrudes toward the outer edge 21 by a distance that is equal to the distance between the apex 222*a* of each first protruding edge portion 222 and the first intersection point P1. Each second protruding edge portion 223 protrudes toward the outer edge 21 by a distance that is equal to the distance between the apex 223*a* of each second protruding edge portion 223 and the second intersection point P2. Preferably, the ratio of the distance by which each second protruding edge portion 223 protrudes toward the outer edge 21 to the distance by which each first protruding edge portion 222 protrudes toward the outer edge 21 is equal to 3:2. In other words, the ratio of the distance between the apex 223*a* of each second protruding edge portion 223 and the second intersection point P2 to the distance between the apex 222*a* of each first protruding edge portion 222 and the first intersection point P1 is equal to 3:2. It is worth noting that the fabric in the outer area outside the outer edge 21 and the inner area surrounded by the inner edge 22 is already applied with the coated material 40 or like liquid substance so that these areas are not permeable, and only the gap region of the printed pattern 20 (that is, the area between the outer edge 21 and the inner edge 22) allows passage of the coated material 40 or like liquid substance. The aforementioned technique is a well-known screen printing technique. Referring to FIGS. 1, 2A and 2B, a fiber fabric 30 has at least a damper forming region 31. The damper forming region 31 has a predetermined coating region 311 and an unintended coating region 312. In the present embodiment, the fiber fabric 30 can be soaked in a resin bath before undergoing the damper coating step according to the present invention: the fiber fabric 30 thereby contains a resin and has an increased hardness. The fiber fabric 30 containing the resin is placed below the screen 10, and the printed pattern 20 is aligned with the predetermined coating region 311, as shown in FIG. 2A. More specifically, the damper forming region 31 has an alignment point 313, and a position detecting device (not shown) can be used to detect the alignment point 313. The screen 10 then can be moved until the printed pattern 20 is aligned with the predetermined coating region 311. Preferably, a center 23 of the printed pattern 20 on the screen 10 is aligned with the alignment point 313 of the damper forming region 31, so that the printed pattern 20 of the screen 10 and the alignment point 313 of the damper forming region 31 are coaxial. The position detecting device can be an infrared position detecting device, a laser position detecting device, or other devices having position detecting functions. In the present embodiment, the fiber fabric 30 is a woven fabric, and includes a plurality of warps and a plurality of wefts woven together. The warps extend along a warp direction D1, and the wefts extend along a weft direction D2 perpendicular to the warp direction D1. When the fiber fabric 30 is placed below the screen 10, the fiber fabric 30 is expanded in the warp direction D1, the first and fourth extending lines L1 and L4 are parallel to the warp direction D1, and the second and third extending lines L2 and L3 are parallel to the weft direction D2. In other embodiments, the fiber fabric 30 can be a non-woven fabric, a screen, or other fabrics suitable for making a damper.

In coating step S2, the coating material 40 is poured into a receptacle 11 at a top of the screen 10 that communicates with the gap region of the printed pattern 20 on the screen 10. A blade 50 is used to distribute the coating material 40 in the receptacle 11 into the gap region of the printed pattern 20. The coating material 40 passes through the gap region of the printed pattern 20 on the screen 10, and flows to the predetermined coating region 311. The material filled in the predetermined coating region 311 thus has a shape that matches with that of the printed pattern 20 on the screen 10, as shown in FIG. 2B. The predetermined coating region 311 has an outer edge 314 and an inner edge 315. The inner edge 315 of the predetermined coating region 311 has a non-circular shape. Preferably, the outer edge 314 of the predetermined coating region 311 has a circular shape, and the inner edge 315 of the predetermined coating region 311 has a wave shape. In the present embodiment, the inner edge 315 of the predetermined coating region 311 has four recessed edge portions 315*a* of curved shapes, two first protruding edge portions 315*b* of curved shapes, and two second protruding edge portions 315*c* of curved shapes. Each second protruding edge portion 315*c* protrudes toward the outer edge 314 of the predetermined coating region 311 by a distance that is greater than the distance by which each first protruding edge portion 315*b* protrudes toward the outer edge 314. More specifically, each first protruding edge portion 315*b* has an apex 315*b*1, the two first protruding edge portions 315*b* are located at opposite positions, and a fifth extending line L5 is defined between the apexes 315*b*1 of the two first protruding edge portions 315*b*. Each second protruding edge portion 315*c* has an apex 315*c*1, the two second protruding edge portions 315*c* are located at opposite positions, and a sixth extending line L6 is defined between the apexes 315*c*1 of the two second protruding edge portions 315*c*. The fifth extending line L5 is parallel to the warp direction D1, and the sixth extending line L6 is parallel to the weft direction D2. Each recessed edge portion 315*a* has an apex 315*a*1, and a seventh extending line L7 is defined between the apexes 315*a*1 of two recessed edge portions 315*a* adjacent to each first protruding edge portion 315*b*. Moreover, an eighth extending line L8 is defined between the apexes 315*a*1 of two recessed edge portions 315*a* adjacent to each second protruding edge portion 315*c*. The seventh extending line L7 is parallel to the weft direction D2 and crosses the fifth extending line L5 at a third intersection point P3. The eighth extending line L8 is parallel to the warp direction D1 and crosses the sixth extending line L6 at a fourth intersection point P4. Each first protruding edge portion 315*b* protrudes toward the outer edge 314 by a distance that is equal to the distance between the apex 315*b*1 of each first protruding edge portion 315*b* and the third intersection point P3. Each second protruding edge portion 315*c* protrudes toward the outer edge 314 by a distance that is equal to the distance between the apex 315*c*1 of each second protruding edge portion 315*c* and the fourth intersection point P4. Preferably, the ratio of the distance by which each second protruding edge portion 315*c* protrudes toward the outer edge 314 to the distance by which each first protruding edge portion 315*b* protrudes toward the outer edge 314 is equal to 3:2. In other words, the ratio of the distance between the apex 315*c*1 of each second protruding edge portion 315*c* and the fourth intersection point P4 to the distance between the apex 315*b*1 of each first protruding edge portion 315*b* and the third intersection point P3 is equal to 3:2. A property of the coating material 40 is to reduce the hardness of the fiber fabric 30 containing the resin, but still allowing the fiber fabric 30 containing the resin to maintain a hardness that is greater than the fiber fabric 30 without the resin. The coating material 40 can include, without limitation, rubber, silicone, foam, or other highly elastic materials with similar properties. In the present embodiment, the damper forming region 31 has an outermost periphery 316 and an innermost periphery 317, the predetermined coating region 311 being adjacent to the outermost periphery 316, as shown in FIG. 2C. In other embodiments, the predetermined coating region 311 can be located between the outermost periphery 316 and the innermost ring 317, or in the innermost periphery 317.

After it is applied with the coating material and baked, the fiber fabric 30 undergoes a cutting step, so that the damper forming region eventually forms a damper 60, as shown in FIG. 3.

One feature of the method described herein is to use a printed pattern 20 on a screen 10 having a non-circular inner edge 22, such that the predetermined coating region 311 of the damper forming region 31 on the fiber fabric 30 including the resin has a non-circular inner edge 315. After the fiber fabric 30 has undergone the coating and baking steps, the inner edge 315 of the predetermined coating region 311 can be converted from a non-circular shape to a predetermined shape. The coating material 40 thereby can be regularly and uniformly distributed on the surface of the damper 60, and the region of the damper 60 softened by the coating material 40 can be regular and uniform, which can reduce noise occurrence and improve the sound quality of the loudspeaker.

With the method described herein, the region softened by the coating material 40 can be substantially consistent for each formed damper 60. As a result, the resonance efficiency of the loudspeaker, which is determined by the damper 60, the voice coil and the diaphragm, can be substantially consistent. The sound quality of each loudspeaker thus can be kept consistent.

Furthermore, because the inner edge 22 of the printed pattern 20 is designed with a wave shape, the inner edge 314 of the predetermined coating region 311 can be converted from the wave shape to an approximately circular shape after the fiber fabric 30 has undergone the aforementioned processing steps for forming a damper. The coating material 40 thereby can be regularly and uniformly distributed in annular shapes on the surface of the damper 60, and the region of the damper 60 softened by the coating material 40 is more regular and more uniform, which can reduce noise occurrence and improve the sound quality of the loudspeaker.

Importantly, because the fiber fabric 30 expands along the warp direction D1, and because the ability of the fiber fabric 30 to extend and elastically retract is better in the weft direction D2 than in the warp direction D1, the inner edge 22 of the printed pattern 20 on the screen 10 has to be designed with a wave shape, and each second protruding edge portion 223 protrudes toward the outer edge 21 by a distance that is greater than the distance by which each first protruding edge portion 222 protrudes toward the outer edge 21. Moreover, when the fiber fabric 30 is placed below the screen 10, the first extending line L1 is parallel to the warp direction D1, and the second extending line L2 is parallel to the weft direction D2. In this manner, the distance by which each second protruding edge portion 315*c* of the inner edge 315 protrudes toward the outer edge 314 of the predetermined coating region 311 can be greater than the distance by which each first protruding edge portion 315*b* of the inner edge 315 protrudes toward the outer edge 314. After the fiber fabric 30 has completed the aforementioned steps for forming a damper, the inner edge 315 can be changed from a wave shape to an approximately circular shape. The coating material 40 thereby can be regularly and uniformly distributed in annular shapes on the surface of the formed damper 60. As a result, the region of the damper 60 softened by the coating material 40 can become more regular and more uniform, which can reduce noise occurrence and improve the sound quality of the loudspeaker.

Importantly, when the ratio of the distance by which each second protruding edge portion 223 protrudes toward the outer edge 21 to the distance by which each first protruding edge portion 222 protrudes toward the outer edge 21 is equal to 3:2, the ratio of the distance by which each second protruding edge portion 315*c* protrudes toward the outer edge 314 to the distance by which each first protruding edge portion 315*b* protrudes toward the outer edge 314 is equal to 3:2. After the fiber fabric 30 has completed the forming step, the inner edge 315 can be thereby changed from a wave shape to an approximately circular shape, so that the region of the damper 60 softened by the coating material 40 can become more regular and more uniform, which can reduce noise occurrence and improve the sound quality of the loudspeaker.

Moreover, regardless the shape of the outer edge 21 of the printed pattern 20 on the screen 10, the shape of the outer edge 314 of the predetermined coating region 311 remains unchanged after the fiber fabric 30 has completed the forming step. It is worth noting that a circular shape of the outer edge 314 is preferable for embodiments in which the inner edge 315 is totally changed from a wave shape to a circular shape. In this manner, the coating material 40 can be regularly and uniformly distributed in annular shapes on the surface of the formed damper 60 after the fiber fabric 30 has undergone the forming step. The region of the damper 60 softened by the coating material 40 can thereby become substantially more regular and substantially more uniform, which can reduce noise occurrence and improve the sound quality of the loudspeaker.

Referring to FIGS. 2C and 3, the formed damper 60 has an outer ring 61 and an inner ring 62. The outer ring 61 of the damper 60 corresponds to the outer periphery 316 of the damper forming region 31 on the fiber fabric 30, and the inner ring 62 of the damper 60 corresponds to the circular inner periphery 317 of the damper forming region 31 on the fiber fabric 30. In the present embodiment, the predetermined coating region 311 is adjacent to the circular outer periphery 316 of the damper forming region 31. Accordingly, the region of the damper 60 adjacent to the outer ring 61 contains both a resin and coating material, and the region of the damper 60 adjacent to the inner ring 62 only contains a resin and has no coating material. In other words, the region of the damper 60 adjacent to the outer ring 61 has a stiffness that is smaller than the stiffness at the region of the damper 60 adjacent to the inner ring 62. Accordingly, the region of the damper 60 adjacent to the outer ring 61 is more flexible and would not easily crack. In the meantime, the resonance efficiency of the loudspeaker, which is commonly determined by the stiffer region of the damper 60 adjacent to the inner ring 62, the voice coil and the diaphragm, can be kept optimal.

In addition, the alignment point 313 of the damper forming region 31 can allow the position detecting device to determine the correct position of the damper forming region 31, so that the center 23 of the printed pattern 20 on the screen 10 can be aligned with the alignment point 313 of the damper forming region 31. In this manner, the printed pattern 20 of the screen 10 can be precisely positioned to match with the predetermined coating region 311 of the damper forming region 31 on the fiber fabric 30.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A method of fabricating a damper having a locally coated material, comprising:

forming a printed pattern on a screen, the printed pattern having an outer edge and an inner edge, the outer edge of the printed pattern having a circular shape and the inner edge of the printed pattern having a wave shape;

providing a fiber fabric having at least a damper forming region, the damper forming region having a predetermined coating region;

soaking the fiber fabric in a resin bath so that the fiber fabric contains a resin and has increased hardness;

placing the fiber fabric containing the resin below the screen so that the printed pattern is aligned with the predetermined coating region;

pouring a coating material on the screen and distributing the coating material over the printed pattern, whereby the coating material flows through a gap region of the printed pattern onto the predetermined coating region, the predetermined coating region thereby having a shape that matches with that of the printed pattern, an outer edge with a circular shape and an inner edge with a wave shape; and after the fiber fabric being applied with the coating material and baked, the fiber fabric undergoing a cutting step so that the damper forming region eventually forms a damper, the shape of the outer edge of the predetermined coating region remains unchanged, and the inner edge of the predetermined coating region is converted from a wave shape to a circular shape, thereby the coating material being regularly and uniformly distributed in annular shapes on the surface of the damper.

2. The method according to claim 1, wherein the inner edge of the printed pattern has four recessed edge portions of curved shapes, two first protruding edge portions of curved shapes, and two second protruding edge portions of curved shapes, each of the recessed edge portions being connected between one first protruding edge portion and one second protruding edge portion, each of the second protruding edge portions protruding toward the outer edge by a distance that is greater than the distance by which each of the first protruding edge portions protrudes toward the outer edge of the printed pattern.

3. The method according to claim 2, wherein each of the first protruding edge portions has a first apex, the two first protruding edge portions are located at opposite positions, and a first extending line is defined between the first apexes of the two first protruding edge portions, each of the second protruding edge portions has a second apex, the two second protruding edge portions are located at opposite positions, and a second extending line is defined between the second apexes of the two second protruding edge portions, the first and second extending lines intersecting with each other at a center of the printed pattern;

wherein the fiber fabric includes a plurality of warps and a plurality of wefts, the warps extend along a warp direction, and the wefts extend along a weft direction perpendicular to the warp direction, when the fiber fabric is placed below the screen, the first extending line is parallel to the warp direction, and the second extending line is parallel to the weft direction;

wherein each of the recessed edge portions has a third apex, a third extending line is defined between the third apexes of the two recessed edge portions adjacent to a same first protruding edge portion, and a fourth extending line is defined between the third apexes of two recessed edge portions adjacent to a same second protruding edge portion, the third extending line being parallel to the weft direction and crossing the first extending line at a first intersection point, the fourth extending line being parallel to the warp direction and crossing the second extending line at a second intersection point, each of the first protruding edge portions protruding toward the outer edge of the printed pattern by a distance that is equal to the distance between the first apex of each first protruding edge portion and the first intersection point, and each of the second protruding edge portions protruding toward the outer edge of the printed pattern by a distance that is equal to the distance between the second apex of each second protruding edge portion and the second intersection point.

4. The method according to claim 3, wherein the ratio of the distance by which each second protruding edge portion protrudes toward the outer edge of the printed pattern to the distance by which each first protruding edge portion protrudes toward the outer edge of the printed pattern is equal to 3:2.

5. The method according to claim 2, wherein the ratio of the distance by which each second protruding edge portion protrudes toward the outer edge of the printed pattern to the distance by which each first protruding edge portion protrudes toward the outer edge of the printed pattern is equal to 3:2.

6. The method according to claim 1, wherein the damper forming region has an alignment point, and the step of placing the fiber fabric below the screen so that the printed pattern is aligned with the predetermined coating region includes using a position detecting device to detect the alignment point and moving the screen until the printed pattern is aligned with the predetermined coating region.

7. A damper having a predetermined coating region with an outer edge and an inner edge;

after the damper being baked and cut off a fiber fabric containing resin, the shape of the outer edge of the predetermined coating region remaining unchanged and being still a circular shape, and the inner edge of the predetermined coating region being converted from a wave shape to a circular shape, thereby a coating material being regularly and uniformly distributed in annular shapes on the surface of the damper.

* * * * *